US006039610A

United States Patent [19]

Pauza et al.

[11] Patent Number: 6,039,610

[45] Date of Patent: Mar. 21, 2000

[54] MULTIPLE CIRCUIT FORK CONTACT CONNECTOR

[75] Inventors: William Vito Pauza, Palmyra; Harold William Kerlin, Elizabethville, both of Pa.

[73] Assignee: The Whitaker Corporation, Wilmington, Del.

[21] Appl. No.: 09/097,280

[22] Filed: Jun. 12, 1998

Related U.S. Application Data

[60] Provisional application No. 60/081,105, Apr. 8, 1998.

[51] Int. Cl.[7] ..... H01R 13/10

[52] U.S. Cl. ..... 439/682; 439/856; 439/857

[58] Field of Search ..... 439/682, 79, 692, 439/699, 638, 646, 650, 655, 80, 91, 66, 856, 857, 842

[56] References Cited

U.S. PATENT DOCUMENTS 4,274,700 6/1981 Keglewitsch et al. ..... 439/682

*Primary Examiner*—Gary F. Paumen
*Assistant Examiner*—Alexander Gilman

[57] ABSTRACT

Improved electrical connectors and an improved technique for mounting metal contacts in an electrical connector. Such a technique employs overlapping, staggered arrays of forked electrical contacts in connector channels which engage corresponding blade contacts in a mating connector. The blades are inserted between prongs of the forked contacts. In the preferred embodiment, the electrical connector has an insulating housing having two parallel arrays of linearly aligned, offset, overlapping channels extending inwardly through a front of the housing. Each of the channel arrays extend inwardly through to two arrays of channels at a rear of the first housing. A forked metallic contact having a planar base, a pair of parallel and coplanar prongs at one of the ends separated by a gap, is mounted in each of the front channels such that the prongs from each forked metallic contact is positioned in one of the channels of the rear arrays of channels. A second housing is mated with the first housing. The second housing has an array of linearly aligned electrical contact blades extending out of the second housing. Each blade being positioned between the prongs of one of the forked electrical contacts within a channel of the rear arrays of channels.

15 Claims, 4 Drawing Sheets

MULTIPLE CIRCUIT FORK CONTACT CONNECTOR

CROSS REFERENCE TO RELATED APPLICATION

This application claims the benefit of provisional patent application 60/081,105 filed Apr. 8, 1998 which is incorporated herein by reference.

FIELD OF THE INVENTION

The present invention relates to electrical connectors or more particularly to an improved technique for mounting metal contacts in an electrical connector. Such a technique employs overlapping, staggered arrays of forked electrical contacts in connector channels which engage corresponding blade contacts in a mating connector . The blades are inserted between prongs of the forked contacts.

BACKGROUND OF THE INVENTION

Electronic equipment, such as computers and cellular telephones, typically contain circuit boards having electronic components which are interconnected via metalized circuitry on the circuit boards. Electrical connectors are frequently used to interconnect a circuit board to other circuit boards or to other components of the equipment. With the continuing advance of electronic technology, more and more individual connections are required in the electronic equipment resulting in highly dense connector packages. When a connector is formed, an insulating housing is provided with an array of electrical contacts mounted in the housing. The contacts must be brought into a mating engagement with those on a circuit board or other connector. The contacts are typically mounted in the connector by inserting each individual contact into a molded channel in a connector housing. Since it has become necessary to employ more and more contacts in connector structures, it has become a problem in the art to find sufficient space to provide for the multiplicity contacts required in the connector housing. It has now been found that by use of a connector having an overlapping staggered arrays of contacts, that more contacts can be accommodated in an individual connector.

SUMMARY OF THE INVENTION

The invention provides an electrical connector comprising:

a first housing comprising an insulating material and having first and second arrays of linearly aligned channels extending inwardly through a front part of the first housing; the first array being parallel to and spaced from the second array; the channels of the first array being linearly offset from and partially overlapping the channels of the second array; each of said channels of the first array of channels extending inwardly through to a channel of a third array of channels at a rear part of the first housing and each of said channels of the second array of channels extending inwardly through to a channel of a fourth array of channels at a rear part of the first housing.

The invention also provides an electrical connector comprising:

(a) a first housing comprising an insulating material and having first and second arrays of linearly aligned channels extending inwardly through a front part of the first housing; the first array being parallel to and spaced from the second array, the channels of the first array being linearly offset from and partially overlapping the channels of the second array; each of said channels of the first array of channels extending inwardly through to a channel of a third array of channels at a rear part of the first housing and each of said channels of the second array of channels extending inwardly through to a channel of a fourth array of channels at a rear part of the first housing (b) a forked metallic contact mounted in each of the channels of the first and second arrays of channels; each forked metallic contact comprising a planar base having two longitudinal ends; a pair of parallel, coplanar prongs at one of the ends separated by a gap; the prongs from each forked metallic contact mounted in a channel of the first array of channels being positioned in one of the channels of the third array of channels and the prongs from each forked metallic contact mounted in a channel of the second array of channels being positioned in one of the channels of the fourth array of channels.

The invention further provides an electrical connector comprising:

(a) a first housing comprising an insulating material and having first and second arrays of linearly aligned channels extending inwardly through a front part of the first housing; the first array being parallel to and spaced from the second array, the channels of the first array being linearly offset from and partially overlapping the channels of the second array; each of said channels of the first array of channels extending inwardly through to a channel of a third array of channels at a rear part of the first housing and each of said channels of the second array of channels extending inwardly through to a channel of a fourth array of channels at a rear part of the first housing;

(b) a forked metallic contact mounted in each of the channels of the first and second arrays of channels; each forked metallic contact comprising a planar base having two longitudinal ends; a pair of parallel, coplanar prongs at one of the ends separated by a gap; the prongs from each forked metallic contact mounted in a channel of the first array of channels being positioned in one of the channels of the third array of channels and the prongs from each forked metallic contact mounted in a channel of the second array of channels being positioned in one of the channels of the fourth array of channels; and (c) a second housing, at least one array of linearly aligned electrical contact blades extending out of said second housing, each blade being positioned between the prongs of one of the forked electrical contacts within a channel of the third or fourth array of channels.

The invention still further provides a method for forming an electrical connection comprising:

(i) providing a first connector portion comprising (a) a first housing comprising an insulating material and having first and second arrays of linearly aligned channels extending inwardly through a front part of the first housing; the first array being parallel to and spaced from the second array; the channels of the first array being linearly offset from and partially overlapping the channels of the second array; each of said channels of the first array of channels extending inwardly through to a channel of a third array of channels at a rear part of the first housing and each of said channels of the second array of channels extending inwardly through to a channel of a fourth array of channels at a rear part of the first housing;

(b) a forked metallic contact mounted in each of the channels of the first and second arrays of channels; each forked metallic contact comprising a planar base having two longitudinal ends; a pair of parallel, coplanar prongs at one of the ends separated by a gap; the prongs from each forked metallic contact mounted in a channel of the first array of channels being positioned in one of the channels of the third array of channels and the prongs from each forked metallic contact mounted in a channel of the second array of channels being positioned in one of the channels of the fourth array of channels;

(ii) providing a second connector portion comprising a second housing, at least one array of linearly aligned electrical contact blades extending out of said second housing, each blade being adapted to be positioned between the prongs of one of the forked electrical contacts within a channel of the third or fourth array of channels; and (iii) mating the first and second connector portions and pressing the blades between the prongs of one of the forked electrical contacts within a channel of the third or fourth array of channels.

Such an electrical connector having an overlapping staggered arrays of contacts, allows more contacts to be accommodated in an individual connector.

DETAILED DESCRIPTION OF THE PREFERRED EMBODIMENT

Figure 1:
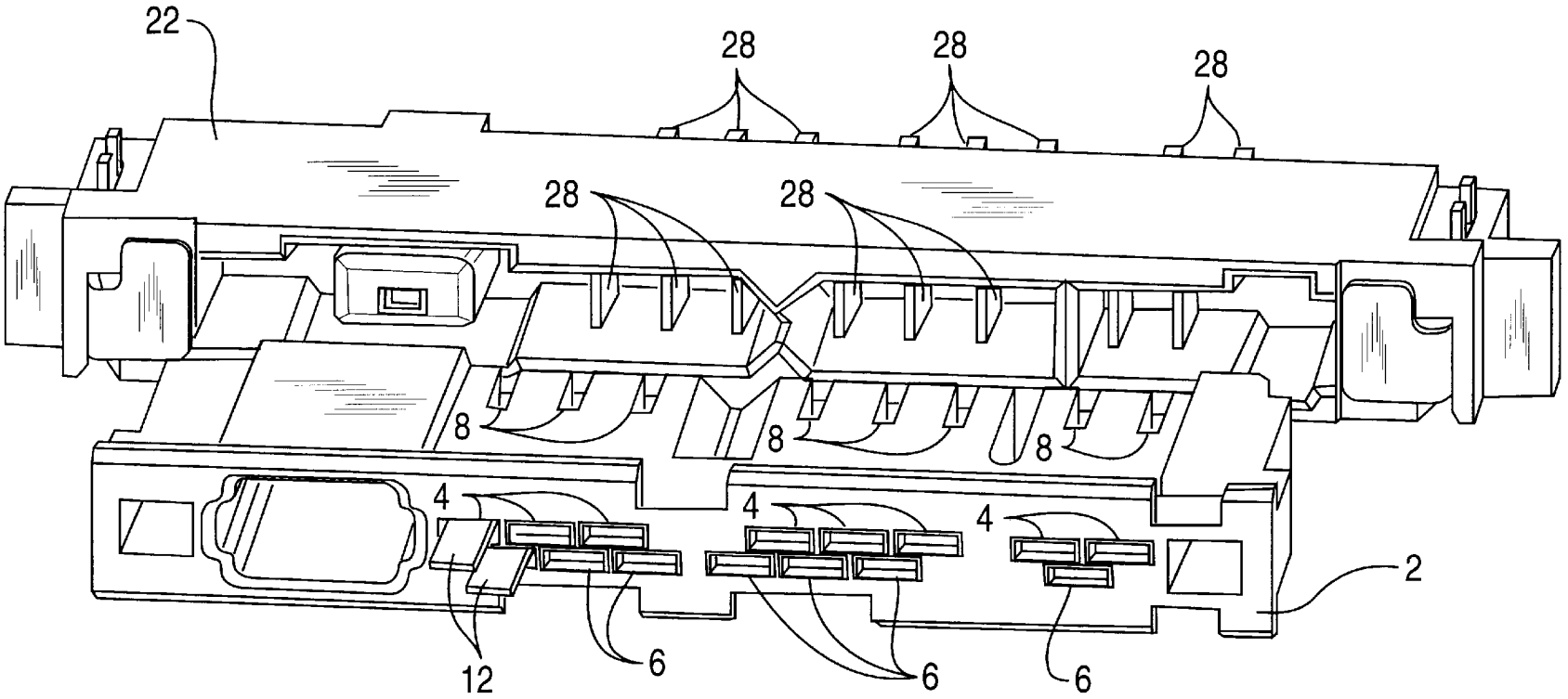
FIG. 1 shows a front perspective view of an electrical connector according to the invention.
Figure 2:
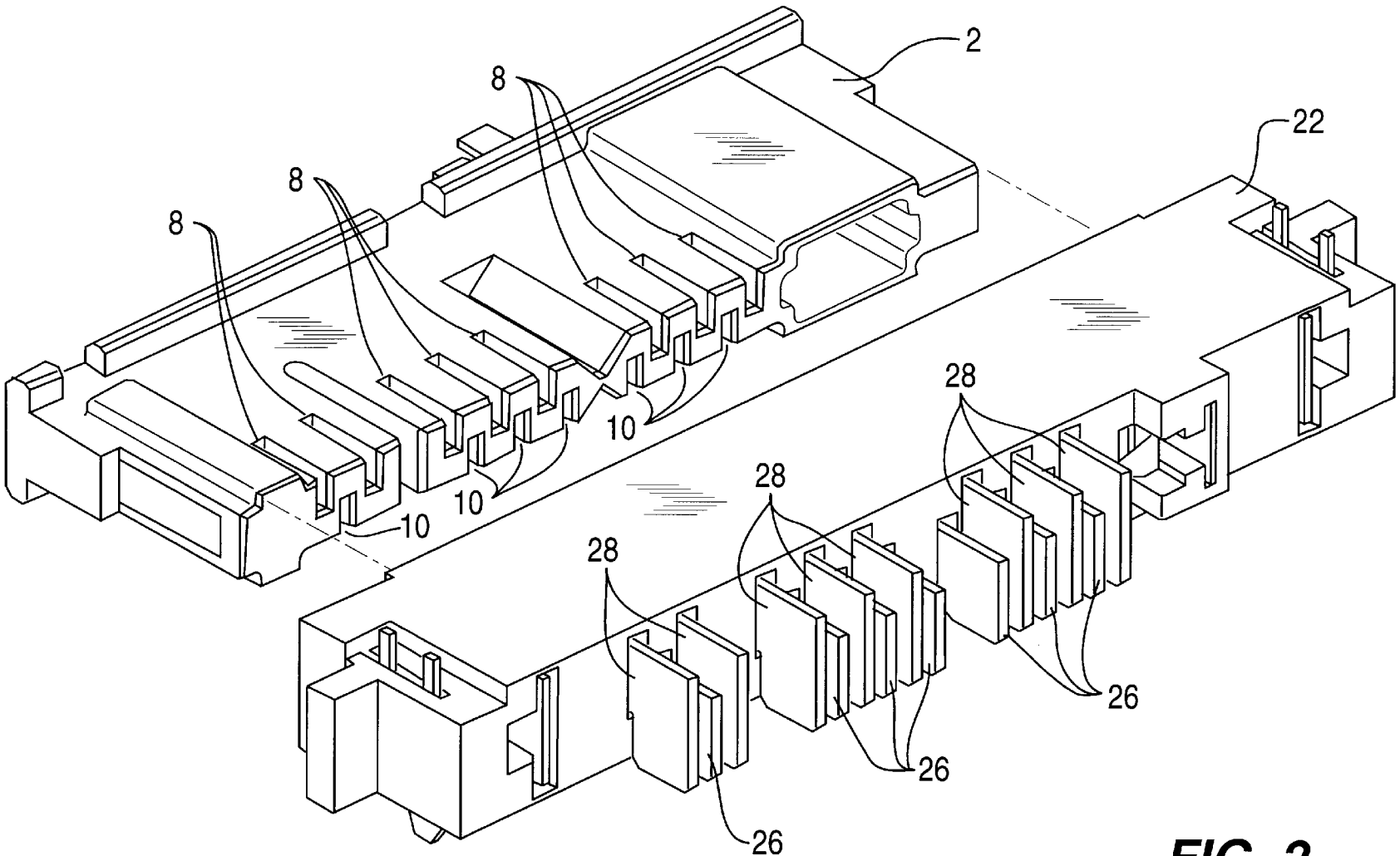
FIG. 2 shows a rear perspective view of an electrical connector according to the invention.

FIG. 1 shows an electrical connector having a first housing 2 comprising an insulating material. The housing 2 may be composed of any suitable thermoplastic dielectric material such as polyamide, polycarbonate, polyester, glass filled polyester or a polyetherimide such as Ultem™ available from GE Plastics. It has a first array 4 of linearly aligned channels extending inwardly through a front part of the housing and a second arrays 6 of linearly aligned channels extending inwardly through a front part of the housing. The first array 4 is set parallel to, linearly offset from and partially overlapping the channels of the second array 6 as shown. Each of the channels of the first array of channels 4 extend inwardly through to a channel of a third array of channels 8 at a rear part of the first housing and each of the channels of the second array 6 of channels extending inwardly through to a channel of a fourth array of channels 10 at a rear part of the first housing 2 as shown in FIG. 2.

Figure 3:
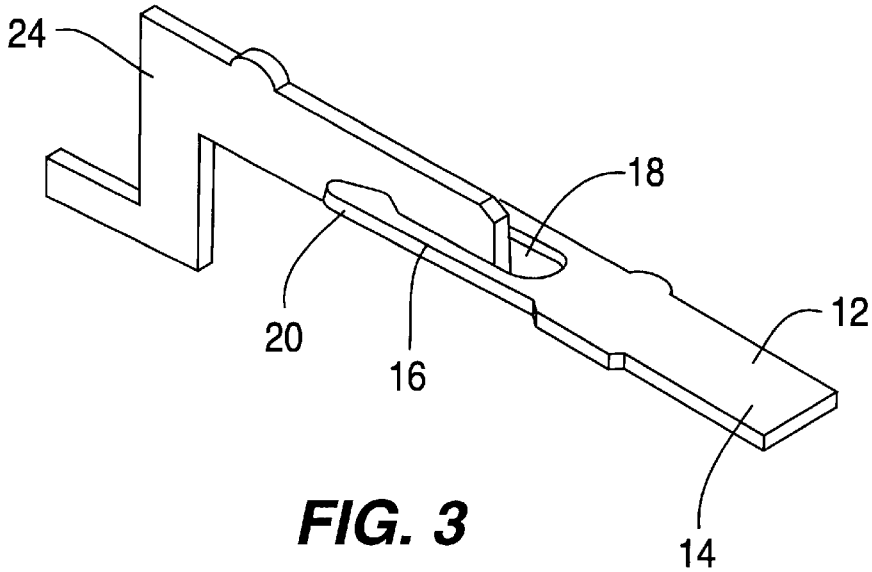
FIG. 3 shows a bladed contact positioned between the prongs a forked electrical contact.

The electrical connector has a forked metallic contact 12 mounted in each of the channels of the first 4 and second 6 arrays of channels. As shown in FIG. 3, each forked metallic contact 12 comprises a planar base 14 having two longitudinal ends. A pair of parallel, coplanar prongs 16 are at one of the ends separated by a gap 18. The prongs from each forked metallic contact 12 are mounted in a channel of the first array of channels 4 and extend through to one of the channels 8 of the third array of channels. The prongs from each forked metallic contact mounted in a channel of the second array of channels 6 are positioned in one of the channels 10 of the fourth array of channels. In the preferred embodiment, prongs 16 have opposed protuberances 20, one on each prong, projecting toward each other into the gap 18.

Figure 4:
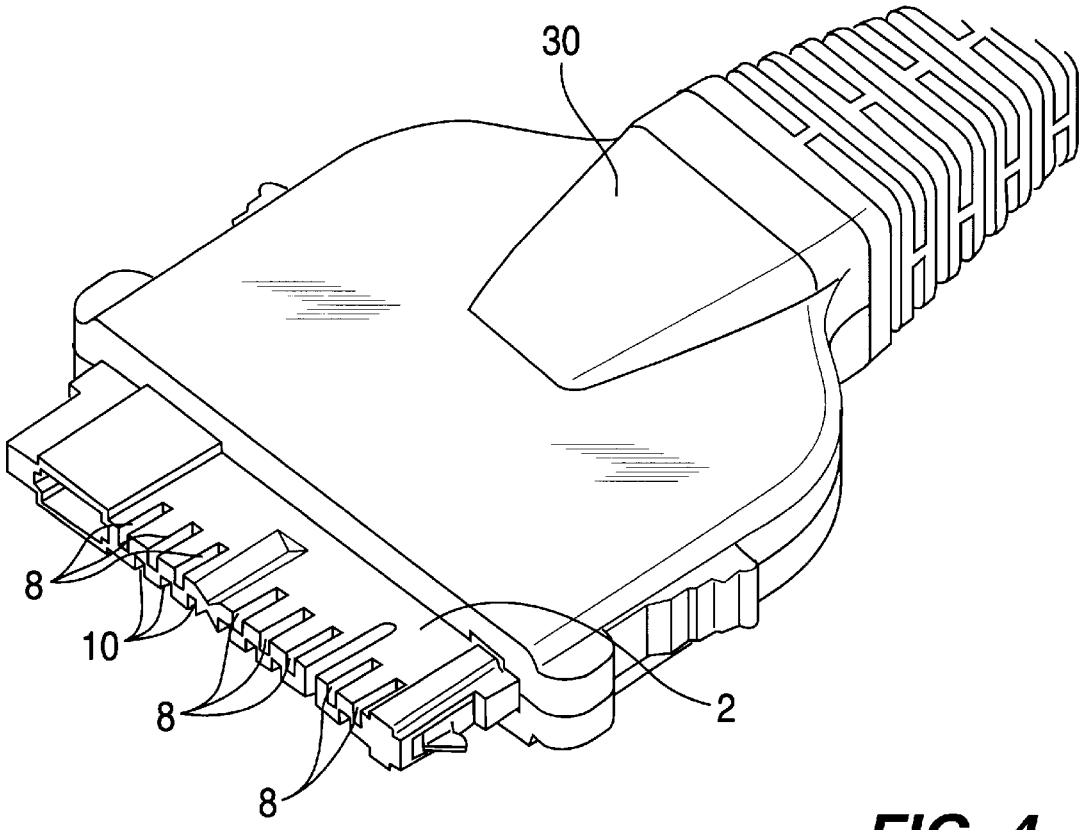
FIG. 4 shows a plug assembly which employs the electrical connector according to the invention.

The electrical connector according to the invention further comprises a second housing 22 which may be composed of the same type of insulating material as the first housing. At least one array of linearly aligned electrical contact blades 24 extend out of the second housing 22. Each blade 24 is positioned between the prongs 16 of one of the forked electrical contacts 12 within a channel of the third or fourth array of channels 8, 10. The blades are positioned between the prongs 16 of the forked electrical contacts as shown in FIG. 3. In the most preferred embodiment, the second housing comprises first and second arrays 26 and 28 respectively, of linearly aligned electrical contact blades 24 extending out of said second housing 22. As shown in FIG. 2, arrays of blades 26 and 28 are staggered such that each of the blades of array 28 mate with forked connectors in channels 8 and each of the blades of array 26 mate with forked connectors in channels 10. As can also be seen, the lower surface of each of arrays of blades 26 and 28 are coplanar to provide a controlled coplanar soldering foot surface. The forked connectors arranged in two parallel planes thus allows a greater concentration of mating connections with blade connectors having a staggered height. This also allows a highly reliability disengageable connection for plug assemblies such as for cellular telephones and the like. In this regard, FIG. 4 shows a typical plug assembly 30 which employs the electrical connector according to the invention.

Figure 6:
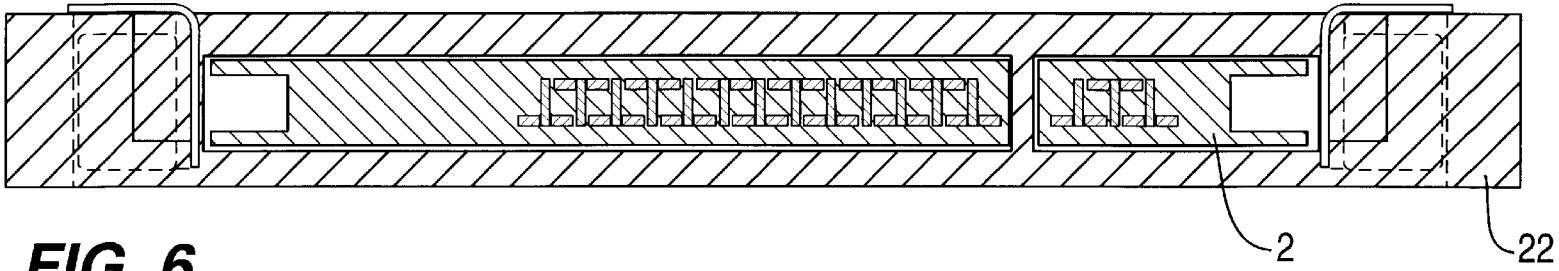
FIG. 6 shows a cross-sectional view taken along line VI—VI from FIG. 5.
Figure 5:
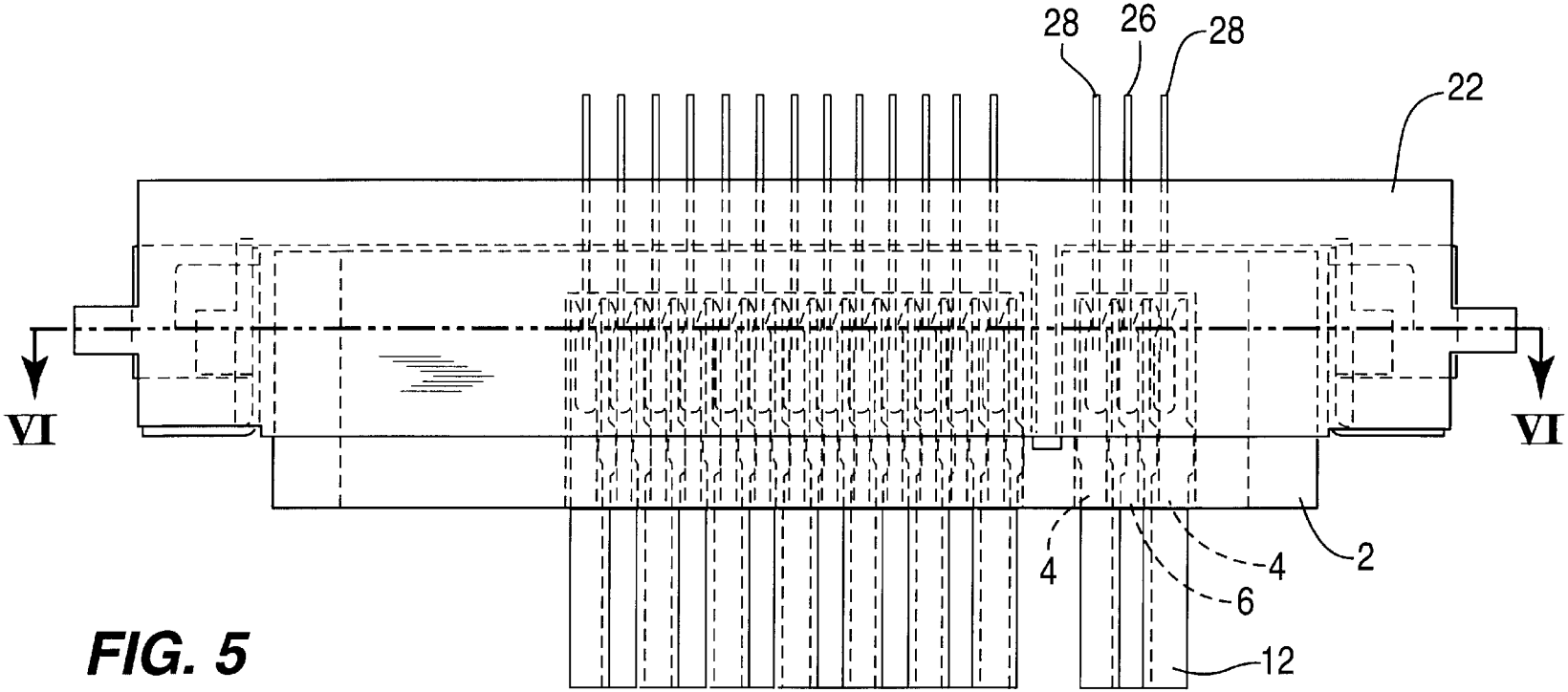
FIG. 5 show a top cross sectional view of mated connector portions.

The increased concentration of connections is shown in FIGS. 5 and 6. FIG. 5 shows a top view of mated connector portions 2 and 22. Wherein each of arrays of blades 26 and 28 engage the prongs of the forked electrical contacts within arrays 4 and 6. FIG. 6 shows a cross-sectional view taken along line VI—VI from FIG. 5. The upper and lower forked connector to blade mating can be seen. The staggering allows the increased concentration of connections. The connector portions 2 and 22 are mated by merely pressing the first and second housings together such that the blades are pressed between the prongs of one of the forked electrical contacts.

An advantage of the present invention is the provision of an electrical connector which has a much greater concentration of connections. In addition, the array of bladed contacts mounted in the connector can be critically aligned with one another for more accurate mating with corresponding forked connectors.

What is claimed is:

1. An electrical connector comprising:

a first housing comprising an insulating material and having first and second arrays of linearly aligned rectangular channels extending inwardly through a front part of the first housing; the first array being parallel to and spaced apart from the second array; the channels of the first array being linearly offset from and partially overlapping the channels of the second array; each of said channels of the first array of channels extending inwardly through to a channel of a third array of rectangular channels at a rear part of the first housing, each channel of said third array being perpendicular to the corresponding channel of said first array, and each of said channels of the second array of channels extending inwardly through to a channel of a fourth array of rectangular channels at a rear part of the first housing, each channel of said fourth array being perpendicular to the corresponding channel of said second array.

2. The electrical connector of claim 1 comprising a forked metallic contact mounted in each of the channels of the first and second array of channels; each forked metallic contact comprising a planar base having two longitudinal ends; a pair of parallel, coplanar prongs at one of the ends separated by a gap; each forked metallic base mounted in a channel of the first array of channels with the prongs positioned in one of the channels of the third array of channels and each forked metallic base mounted in a channel of the second array of channels with the prongs positioned in one of the channels of the fourth array of channels, wherein the base of each contact is coplanar with the longest of the length or width dimension of its channel face.

3. The electrical connector of claim 2 further comprising a pair of opposed protuberances, one on each prong, projecting toward each other into the gap.

4. The electrical connector of claim 2 further comprising a second housing, at least one array of linearly aligned electrical contact blades extending out of said second housing, each blade being positioned between the prongs of one of the forked electrical contacts within a channel of the third or fourth array of channels.

5. The electrical connector of claim 4 comprising first and second arrays of linearly aligned electrical contact blades extending out of said second housing, each blade of the first array of contact blades being positioned between the prongs of one of the forked electrical contacts within a channel of the third array of channels and each blade of the second array of contact blades being positioned between the prongs of one of the forked electrical contacts within a channel of the fourth array of channels.

6. An electrical connector comprising:

(a) a first housing comprising an insulating material and having first and second arrays of linearly aligned rectangular channels extending inwardly through a front part of the first housing; the first array being parallel to and spaced apart from the second array; the channels of the first array being linearly offset from and partially overlapping the channels of the second array; each of said channels of the first array of channels extending inwardly through to a channel of a third array of rectangular channels at a rear part of the first housing, each channel of said third array being perpendicular to the corresponding channel of said first array and each of said channels of the second array of channels extending inwardly through to a channel of a fourth array of rectangular channels at a rear part of the first housing, each channel of said fourth array being perpendicular to the corresponding channel of said second array; and (b) a forked metallic contact mounted in each of the channels of the first and second array of channels; each forked metallic contact comprising a planar base having two longitudinal ends; a pair of parallel, coplanar prongs at one of the ends separated by a gap; each forked metallic base mounted in a channel of the first array of channels with the prongs positioned in one of the channels of the third array of channels and each forked metallic base mounted in a channel of the second array of channels with the prongs positioned in one of the channels of the fourth array of channels, wherein the base of each contact is coplanar with the longest of the length or width dimension of its channel face.

7. The electrical connector of claim 6 further comprising a pair of opposed protuberances, one on each prong, projecting toward each other into the gap.

8. The electrical connector of claim 6 further comprising a second housing, at least one array of linearly aligned electrical contact blades extending out of said second housing, each blade being positioned between the prongs of one of the forked electrical contacts within a channel of the third or fourth array of channels.

9. The electrical connector of claim 8 comprising first and second arrays of linearly aligned electrical contact blades extending out of said second housing, each blade of the first array of contact blades being positioned between the prongs of one of the forked electrical contacts within a channel of the third array of channels and each blade of the second array of contact blades being positioned between the prongs of one of the forked electrical contacts within a channel of the fourth array of channels.

10. An electrical connector comprising:

(a) a first housing comprising an insulating material and having first and second arrays of linearly aligned rectangular channels extending inwardly through a front part of the first housing; the first array being parallel to and spaced apart from the second array; the channels of the first array being linearly offset from and partially overlapping the channels of the second array; each of said channels of the first array of channels extending inwardly through to a channel of a third array of rectangular channels at a rear part of the first housing, each channel of said third array being perpendicular to the corresponding channel of said first array, and each of said channels of the second array of channels extending inwardly through to a channel of a fourth array of rectangular channels at a rear part of the first housing, each channel of said fourth array being perpendicular to the corresponding channel of said second array;

(b) a forked metallic contact mounted in each of the channels of the first and second array of channels; each forked metallic contact comprising a planar base having two longitudinal ends; a pair of parallel, coplanar prongs at one of the ends separated by a gap; each forked metallic base mounted in a channel of the first array of channels with the prongs positioned in one of the channels of the third array of channels and each forked metallic base mounted in a channel of the second array of channels with the prongs positioned in one of the channels of the fourth array of channels, wherein the base of each contact is coplanar with the longest of the length or width dimension of its channel face; and (c) a second housing, at least one array of linearly aligned electrical contact blades extending out of said second housing, each blade being positioned between the prongs of one of the forked electrical contacts within a channel of the third or fourth array of channels.

11. The electrical connector of claim 10 further comprising a pair of opposed protuberances, one on each prong, projecting toward each other into the gap.

12. The electrical connector of claim 10 comprising first and second arrays of linearly aligned electrical contact blades extending out of said second housing, each blade of the first array of contact blades being positioned between the prongs of one of the forked electrical contacts within a channel of the third array of channels and each blade of the second array of contact blades being positioned between the prongs of one of the forked electrical contacts within a channel of the fourth array of channels.

13. A method for forming an electrical connection comprising:

(i) providing a first connector portion comprising (a) a first housing comprising an insulating material and having first and second arrays of a linearly aligned rectangular channels extending inwardly through a front part of the first housing; the first array being parallel to and spaced apart from the second array; the channels of the first array being linearly offset from and partially overlapping the channels of the second array; each of said channels of the first array of channels extending inwardly through to a channel of a third array of rectangular channels at a rear part of the first housing, each channel of the third array perpendicular to the corresponding channel of the first array, and each of said channels of the second array of channels extending inwardly through to a channel of a fourth array of rectangular channels at a rear part of the first housing, each channel of the fourth array perpendicular to the corresponding channel of the second array; and (b) a forked metallic contact mounted in each of the channels of the first and second array of channels; each forked metallic contact comprising a planar base having two longitudinal ends; a pair of parallel, coplanar prongs at one of the ends separated by a gap; each forked metallic base mounted in a channel of the first array of channels with the prongs positioned in one of the channels of the third array of channels and each forked metallic base mounted in a channel of the second array of channels with the prongs positioned in one of the channels of the fourth array of channels, wherein the base of each contact is coplanar with the longest of the length or width dimension of its channel face;

(ii) providing a second connector portion comprising a second housing, at least one array of linearly aligned electrical contact blades extending out of said second housing, each blade being positioned between the prongs of one of the forked electrical contacts within a channel of the third or fourth array of channels; and (iii) mating the first and second connector portions and pressing the blades between the prongs of one of the forked electrical contacts within a channel of the third or fourth array of channels.

14. The method of claim 13 further comprising providing a pair of opposed protuberances, one on each prong, projecting toward each other into the gap.

15. The method of claim 13 comprising providing first and second arrays of linearly aligned electrical contact blades extending out of said second housing, each blade of the first array of contact blades being adapted to be positioned between the prongs of one of the forked electrical contacts within a channel of the third array of channels and each blade of the second array of contact blades being adapted to be positioned between the prongs of one of the forked electrical contacts within a channel of the fourth array of channels; and mating the first and second connector portions and pressing the blades of the first array of contact blades between the prongs of one of the forked electrical contacts within a channel of the third array of channels and pressing the blades of the second array of contact blades between the prongs of one of the forked electrical contacts within a channel of the fourth array of channels.

* * * * *